United States Patent [19]

Anderson

[11] Patent Number: 4,867,478

[45] Date of Patent: Sep. 19, 1989

[54] LOCKING CABLE FOR SKIS AND POLES

[76] Inventor: Robert L. Anderson, 30 Yardley La., Schaumburg, Ill. 60194

[21] Appl. No.: 238,475

[22] Filed: Aug. 31, 1988

[51] Int. Cl.[4] ..... A63C 11/00

[52] U.S. Cl. ..... 280/814; 70/30; 70/49; 211/70.5; 294/147

[58] Field of Search ..... 280/811, 814, 815; 211/70.5; 294/147; 70/30, 49

[56] References Cited

U.S. PATENT DOCUMENTS

| | | | |
|---|---|---|---|
| 3,257,054 | 6/1966 | Miesel | 280/814 X |
| 3,590,608 | 7/1971 | Smyth | 280/814 X |
| 3,768,711 | 10/1973 | Wilkinson | 294/147 X |
| 3,838,585 | 10/1974 | Foote | 280/814 X |
| 4,185,361 | 1/1980 | Stuart | 280/814 X |

FOREIGN PATENT DOCUMENTS

| | | | |
|---|---|---|---|
| 2469190 | 5/1981 | France | 294/147 |
| 2586581 | 3/1987 | France | 294/147 |

*Primary Examiner*—Charles A. Marmor
*Assistant Examiner*—Brian L. Johnson
*Attorney, Agent, or Firm*—Dillis V. Allen

[57] ABSTRACT

A multiple purpose cable assembly for locking and alternatively carrying skis and poles, with a first cable section having eyelets at both ends and a second shorter cable section connected to one end of the first cable section with an eyelet at its distal end, the short cable section defining a fairly tight loop around the skis in both locking and carrying modes, and longer cable section defining a short loop around the skis and a handle in the carrying mode, and a long loop around the skis and an immovable object in the locking mode.

4 Claims, 3 Drawing Sheets

LOCKING CABLE FOR SKIS AND POLES

BACKGROUND OF THE INVENTION

Because theft is a significant problem in commercial ski areas, various types of ski and pole locking devices have found their way to the marketplace over the last decade. While these locking devices have achieved a certain degree of commercial success because of the need for this type of product, their success has been limited because of the high manufacturing costs of these locking devices customized for the ski and pole market. A large part of the cost is due to their integral locks that cannot be used for any purpose other than locking skis and poles.

There have also been provided in the snow-ski market a plurality of straps designed particularly for carrying skis, but insofar as I am aware none of these carrying devices is also capable of locking skis to a fixed abutment in the commercial ski area.

It is the primary object to the present invention to ameliorate the problems noted above in locking and carrying skis.

SUMMARY OF THE PRESENT INVENTION

In accordance with the present invention a multipurpose cable assembly is provided for both locking and carrying skis and poles that utilizes in both locking and carrying modes a single general purpose lock. Because the lock may be a standard one the cable assembly can be marketed and sold without the lock with the user supplying his own after purchase.

Toward this end the cable assembly includes a long first cable section with eyelets at both ends and second shorter cable section connected to one end of the first cable section, with an eyelet at its distal end. The short cable section provides a short loop around the skis in both carrying and locking modes. The longer cable section when threaded upon itself defines a short loop around the skis and a handle in the carrying mode, and without it being threaded upon itself defines a long loop around an immovable object in the ski area in the locking mode.

The cable assembly includes a braided steel cable having a vinyl sheathing that protects both the cable and the user from damage or injury. The eyelets at the ends of both the long and short cable sections are formed by looping the cable and applying a crimped aluminum ferrule over the adjacent cable portions. The ferrule is protected by a vinyl cup protector assembled after crimping.

An important aspect of the present invention is that both long and short cable sections are formed from a single continuous steel cable with the division between long and short sections being provided by an intermediate loop and ferrule in the continuous cable.

In the locking mode, the user wraps the long cable section around a fixed abutment in the ski area and wraps the short cable section around the skis and poles intermediate the binding assemblies aligning the three eyelets for reception of the lock.

In the ski and pole carrying mode, the end of the long cable section carrying the short cable section is threaded through the former's other end defining a first loop around the skis and poles at one end of skis' binding assemblies, and thereafter the short cable section is looped around the skis and poles at the other end of the binding assemblies defining a second loop with the ends of the short section receiving the lock and the portion of the first cable section between the first and second loops defining a carrying handle for the skis and poles.

Another important aspect of the present invention is that a single locking device is used to lock the cable assembly in both the carrying mode and the locking mode.

A further object of the present invention is to provide a cable assembly readily attachable to another cable assembly to provide an increased length locking and carrying device.

Other objects and advantages of the present invention will appear from the following detailed description.

DETAILED DESCRIPTION OF THE PREFERRED EMBODIMENT

Figure 1:
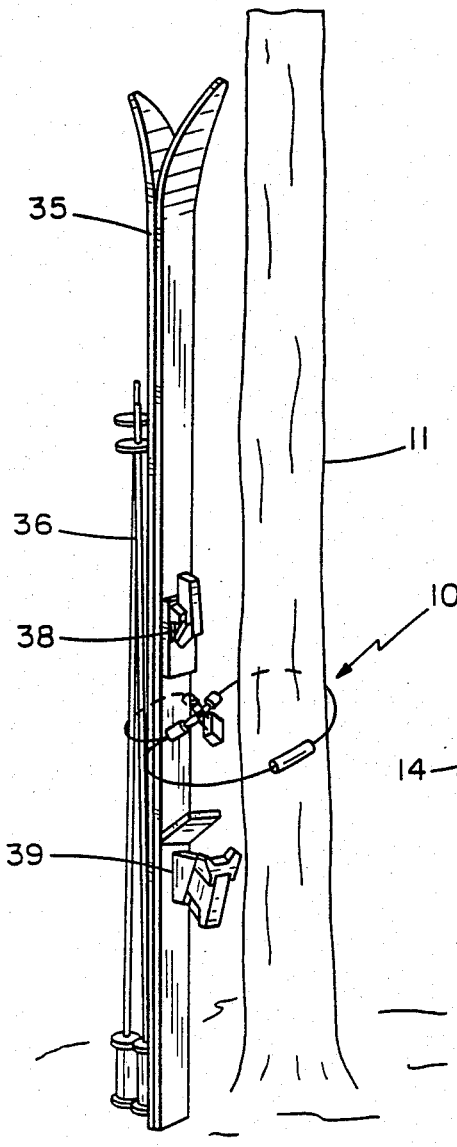
FIG. 1 is a perspective view of the present locking cable assembly for skis and poles shown locking a standard set of skis and poles to a small tree.
Figure 2:
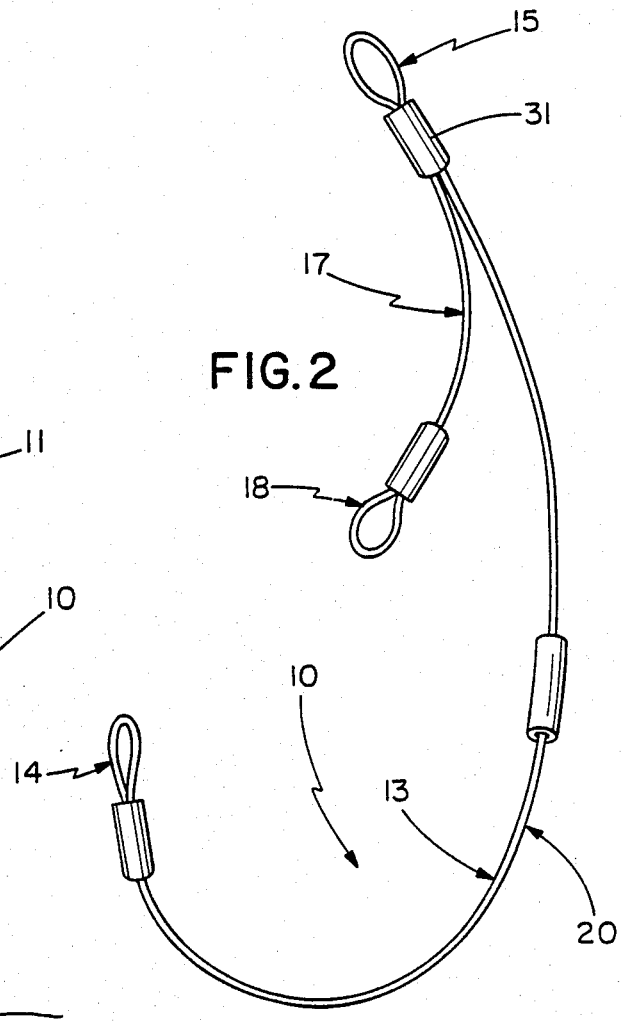
FIG. 2 is a plan view of the present cable assembly in its relaxed position.
Figure 9:
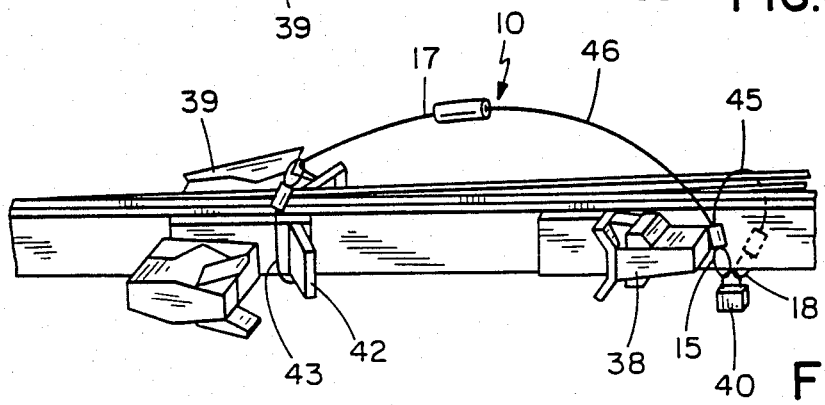
Figure 10:
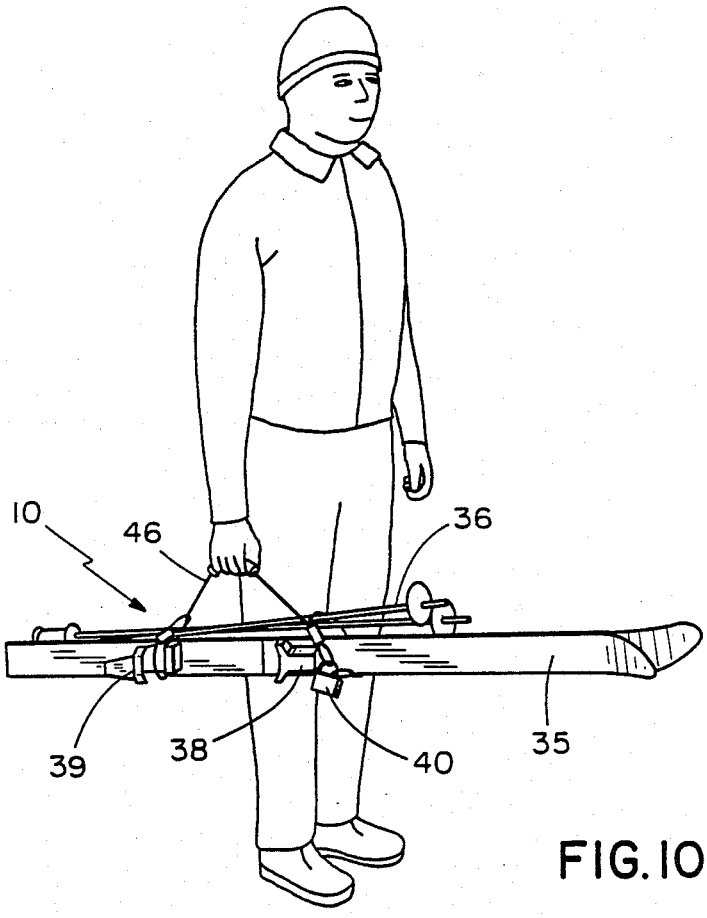
FIG. 10 is a perspective view of a person carrying a set of skis and poles with the cable assembly in its carrying mode.

Referring to the drawings and particularly FIGS. 1 and 2, a cable assembly 10 is illustrated according to the present invention and is shown in FIG. 1 in its locking mode attaching a standard set of skis and poles to a tree 11. The same cable assembly 10 is illustrated in FIGS. 9 and 10 in its carrying mode.

As seen in FIG. 2, the cable assembly 10 includes a first cable section 13 having loop eyelets 14 and 15 at either end, and a second shorter cable section 17 connected at one end to one end of the first cable section 13 and having a loop eyelet 18 at its distal end. The first cable section 13 is 36 inches in length from the tip of eyelet 14 to the tip of eyelet 15 and the second cable section 17 is 11 ¼ inches in length from the tip of eyelet 18 to the tip of eyelet 15. The eyelet 15 actually defines an eyelet for both the first cable section 13 and the section cable section 17 as will appear more clearly below.

Figure 3:
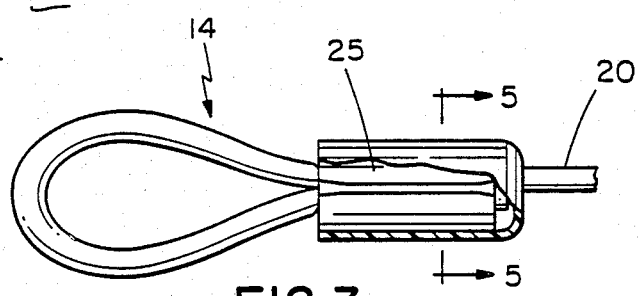
FIG. 3 is an enlarged fragmentary view of one of the eyelet loops in the assmebly illustrated in FIG. 2.
Figure 4:
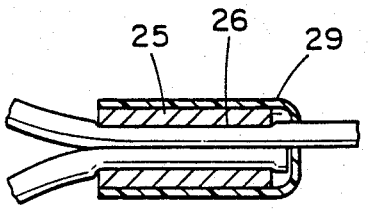
FIG. 4 is a longitudinal section through one of the ferrules illustrated in FIGS. 2 and 3, taken generally along line 4—4 of FIG. 5.
Figure 5:
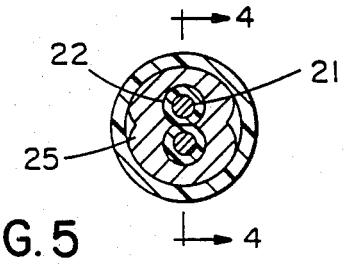
FIG. 5 is a cross-section of one of the ferrules taken along line 5—5 of FIG. 3.

Eyelet 14 is illustrated in FIGS. 3, 4 and 5 with the understanding that the cable and eyelet 14 are substantially the same as eyelets 15 and 18.

An important aspect of the present invention is that the cable assembly 10 is made from a single continuous length of cable 20 having an internal steel braided flexible rod 21 covered by a uniform diameter vinyl sheathing 22 as seen in FIG. 5.

The eyelet are formed by simply looping the cable 20 and crimping an aluminum ferrule 25 around the contiguous cable portions 26 forming the loop, and a thin vinyl cup shaped cover 29 is applied over the ferrule for protection and user comfort.

The loop eyelet 15 is formed by simply looping the appropriate intermediate portion of cable 20 and apply a ferrule 31 thereto so that cable section 13 and cable section 17 are actually part of the same cable 20.

As illustrated in FIGS. 1, 6, 7, 8, 9 and 10 a standard set of skis 35 is illustrated with standard poles 36. The skis have forward binding assemblies 38 and heel or rear binding assemblies 39 fixed thereto that define the locations for the cable assembly 10 in both the locking mode and the carrying mode.

Figure 6:
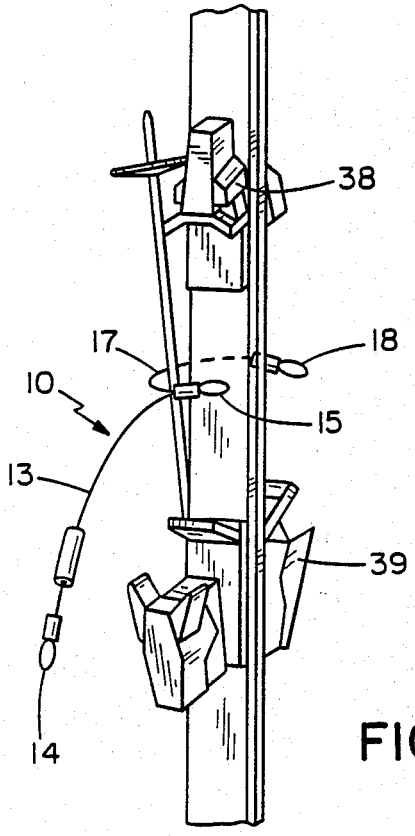
FIGS. 6 and 7 illustrate the manner of placing the present cable assembly in its locking mode around a standard pair of skis and a small tree in the ski area.
Figure 7:
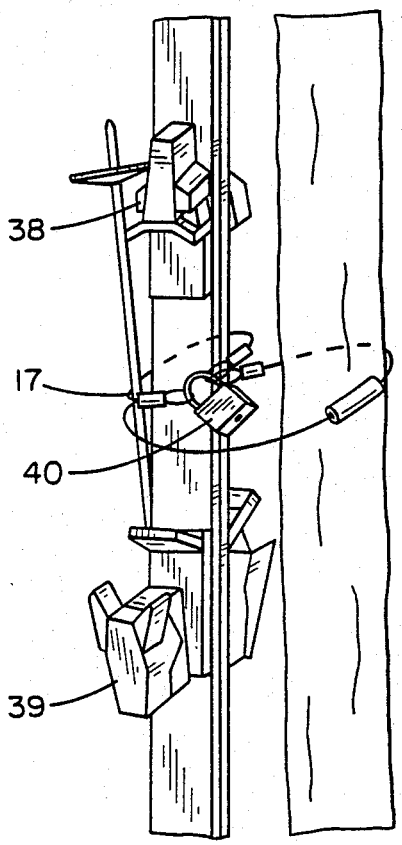
Figure 11:
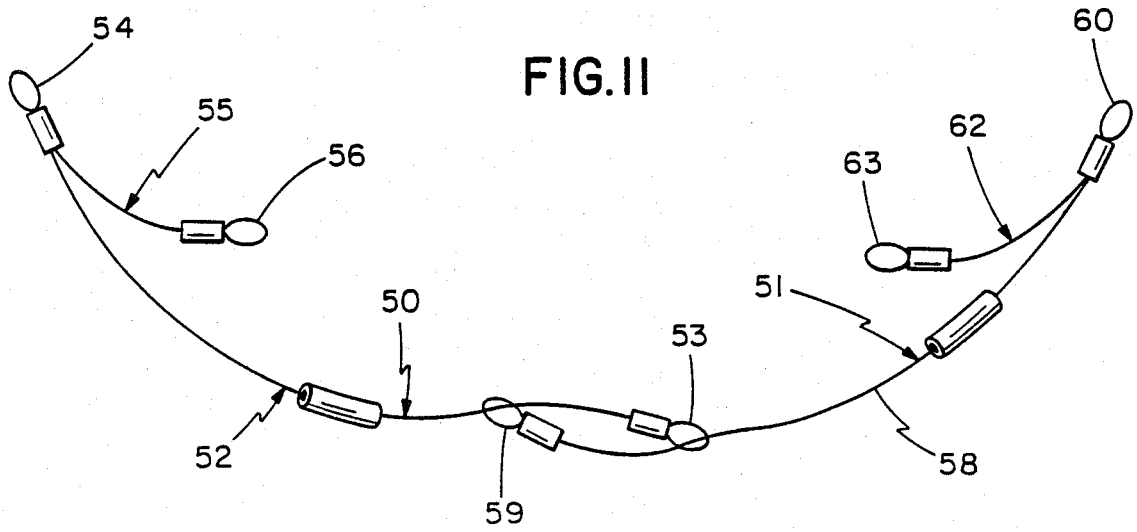
FIG. 11 is a plan view of two cable assemblies locked together to extend the length thereof.

The length of cable section 17 as noted above is 11¼ inches and this length is determined by the distance around the skis and poles intermediate the binding assemblies 38 and 39 as seen in FIG. 6 and the length is short enough so that after looping cable section 17 about the skis and poles, the resulting loop with its lock in position as shown in FIG. 7 is incapable of passing over either binding assemblies 38 or 39. The length of the longer cable section 13, i.e. 36 inches,is selected so that it is capable of passing around a small tree as illustrated in FIG. 11 and also in the carrying mode as illustrated in FIG. 9 has sufficient play to enable the skis to be comfortably carried as illustrated in FIG. 10.

It should be understood that the length of the sections 13 and 17 is selected with reference to an average pair of male skis and the dimensions of the most commonly bindings found in today's marketplace.

Referring to FIGS. 6 and 7 the procedure for placing the cable assembly 10 in its locking mode is illustrated. The shorter cable section 17 is initially wrapped around the skis and poles and an open lock is applied to eyelets 15 and 18. Thereafter the longer section 13 is wrapped around a small tree or a railing in the ski area and then eyelet 14 is inserted in open lock 40 and the lock is closed as illustrated in FIG. 7. Note that the loop formed by the shorter cable section 17 when locked as shown in FIG. 7 is sufficiently small so that it will not pass over either binding assemblies 38 or 39 or permit either end of the poles 36 to pass therethrough.

Figure 8:
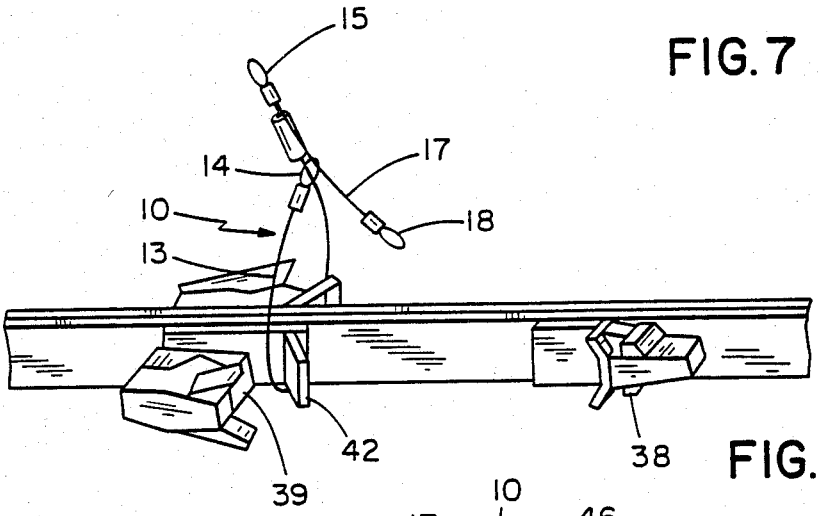
FIGS. 8 and 9 illustrate the manner of placing the present cable assembly in its carrying mode around a pair of standard skis.

Referring to FIGS. 8, 9 and 10 illustrating the procedure for placing the cable 10 in its carrying mode, the long cable section 13 is looped around heel engaging portion 42 of the rear binding assemblies 39 and the eyelet 15 and cable section 17 are then threaded through eyelet 14 thereby providing a first loop 43 around the skis and poles. Thereafter the shorter cable section is looped around the skis and poles in front of front bindings 38 and locked with lock 40 through eyelets 15 and 18, thereby defining a second loop 45 around the skis and, with a portion 46 of cable section 17 extending quite loosely between the loops 43 and 45, thereby defining a cable handle for the skis and the poles as illustrated in FIG. 10.

As seen in FIG. 11, cable assemblies 50 and 51 are illustrated identical to the cable assembly illustrated in FIGS. 1 to 10 and as seen may be connected together providing greater cable length. Toward this end cable assembly 50 has a first cable section 52 with eyelets 53 and 54 at either end and short cable section 55 connected to one end of cable section 52 and having an eyelet 56 at its distal end.

A similarly identical cable 51 has a long cable section 58 having eyelets 59 and 60 at either end and a shorter cable section 62 connected to one end of the cable section 58 and having an eyelet 63 at its free end.

The cables 50 and 51 are interconnected together in the manner shown in FIG. 11 by threading the eyelet 54 of cable 50 through eyelet 59 of cable 58, and then threading eyelet 60 of cable 58 through eyelet 53 of cable 50 and then pulling the two cables apart until the eyelets 53 and 59 are next to one another. The resulting assembly can be utilized to lock skis and poles around larger fixed abutments and also can be utilized to achieve the carrying mode illustrated in FIG. 9 with much greater length than a single handle portion 46. Furthermore this dual assembly can also be utilized in this mode to lock more than one pair of skis and poles around a large abutment by interconnecting the short cable sections 55 and 62 about different skis sets and then locking eyelets 54, 56, 60 and 63 all to the same lock with the cable sections 52 and 58 passing around the fixed abutment.

I claim:

1. A multipurpose cable assembly for poles and skis that utilizes a standard completely removable lock, comprising: an elongated cable assembly having a first cable section and a second shorter cable section fixed to one end of the first cable section, said first cable section having locking apertures at each end thereof formed by short loops in the cable section one of which is a common locking aperture, said second cable section being connected at one end to the first cable section at the common locking aperture end thereof so that it uses the common locking aperture in the first cable section, said second cable section having a locking aperture at its other end, said cable assembly being positionable in a ski carrying mode with the first cable section defining a first loop around the skis by threading the common locking aperture through the other locking aperture in the first cable section, the second cable section defining a second loop around the skis by aligning the common aperture and the locking aperture in the second cable section and passing the lock therethrough, with a portion of the first cable section extending between the first and second loops defining a carrying handle, said cable assembly also being positionable in a ski-pole locking mode to a fixed free standing support with the first cable section extending around the fixed support and the second cable section extending around just the poles and skis, and aligning the common aperture with the first cable section and second cable second apertures and passing the lock simultaneously through all the apertures.

2. A multipurpose cable assembly for poles and skis that utilizes a standard completely removable lock as defined in claim 1, including a tubular handle member connected to the first cable section.

3. A multipurpose cable assembly for poles and skis that utilizes a standard completely removable lock as defined in claim 1, wherein the short loops in both cable sections are formed by crimped aluminum ferrules.

4. A multipurpose cable assembly for poles and skis that utilizes a standard completely removable lock as defined in claim 1, wherein the first cable section and the second cable section are formed from a single continuous length of cable having an integral steel braided flexible rod covered by a uniform diameter vinyl sheathing.

* * * * *